US006340049B1

(12) United States Patent
Lehman et al.

(10) Patent No.: US 6,340,049 B1
(45) Date of Patent: Jan. 22, 2002

(54) DEVICE FOR CASTING OF METAL

(75) Inventors: Anders Lehman, Bromma; Erik Svensson, Västerås; Tord Kroon, Västerås; Jan-Erik Eriksson, Västerås, all of (SE)

(73) Assignee: ABB AB, Västerås (SE)

( * ) Notice: Subject to any disclaimer, the term of this patent is extended or adjusted under 35 U.S.C. 154(b) by 0 days.

(21) Appl. No.: 09/623,379

(22) PCT Filed: Mar. 3, 1999

(86) PCT No.: PCT/SE99/00313

§ 371 Date: Sep. 1, 2000

§ 102(e) Date: Sep. 1, 2000

(87) PCT Pub. No.: WO99/44769

PCT Pub. Date: Sep. 10, 1999

(30) Foreign Application Priority Data

Mar. 6, 1998 (SE) ..... 9800736

(51) Int. Cl.[7] ..... B22D 27/02; B22D 11/124; B22D 11/00

(52) U.S. Cl. ..... 164/471; 164/418; 164/443; 164/459; 164/485

(58) Field of Search ..... 164/471, 507, 164/418, 443, 459, 485, 466, 467, 468, 502, 503, 504

(56) References Cited

U.S. PATENT DOCUMENTS 4,572,812 A * 2/1986 Ciszek ..... 264/25
4,838,933 A * 6/1989 Paillere et al. ..... 75/10.14
5,375,648 A 12/1994 Idogawa et al.
5,390,725 A * 2/1995 Berclaz et al. ..... 164/467

FOREIGN PATENT DOCUMENTS

EP 0 165 793 A2 * 12/1985
JP 7-148554 * 6/1995
JP 7204789 8/1995
WO 9921670 5/1999

OTHER PUBLICATIONS

Patent Abstracts of Japan, vol. 18, No. 254, May 16, 1994, entitled "Apparatus for Continuously Casting Metal" of Yoshida Masaru, derived from JP 60–39499.
M. Morishita et al., "Meniscus Shape and Flow in an Electromagnetic Mold" in Magnetohydrodynamics in Process Metallurgy, The Minerals, Metals and Materials Society, pp. 267–272.
H. Nakata et al., "Improvement of Surface Quality of Steel by Electromagnetic Mold" in International Symposium on Electromagnetic Processing of Materials, 1994, Nagoya, pp. 166–171.

(List continued on next page.)

*Primary Examiner*—M. Alexandra Elve
*Assistant Examiner*—Len Tran
(74) *Attorney, Agent, or Firm*—Dykema Gossett PLLC

(57) ABSTRACT

A device for continuous or semi-continuous casting of metal comprising a cooled mold (22) and an induction coil (10) arranged at the top end of the mold. The mold comprises in its top end a plurality of hollow, old segments (**22*a*, 22*b*, 22*c*, 22*d*, 22*e*, 22*f*, 22′*b*, 22′*c*, 22′*d*) separated from each other by partitions (26*a*, 26*b*, 26*c*, 26*d*, 26*e*), which all comprise an electrically insulating barrier. Both the mold segments and the partitions are oriented essentially in the casting direction. Each hollow top end mold segment comprises a core of a mechanically supporting bar or beam (25*a*, 25*b*, 25*c*, 25*d*, 25*e*, 25*f*, 25′*a*, 25′*b*, 25′*c*, 25′*d*, 25′*e*, 25′*f***) arranged within the hollow mold segment such that it is surrounded by the hollow mold segment. The core exhibits superior mechanical properties in relation to the mold.

22 Claims, 3 Drawing Sheets

OTHER PUBLICATIONS

Tingju Li et al., "Dynamic Meniscus Behavior . . . and Surface Quality of Products" in International Symposium on Electromagnetic Processing of Materials, 1994, Nagoya, pp. 242–247.

Takehiko Toh et al., "Electromagnetic Control of Initial Specification . . . Alternating Magnetic Field" in ISIJ International, vol. 37 (1997), No. 11, pp. 1112–1119.

* cited by examiner

DEVICE FOR CASTING OF METAL

TECHNICAL FIELD

The present invention relates to a device for continuous or semi-continuous casting of metal or metal alloys into an elongated strand, where the strand is cast using a device comprising a cooled continuous casting mold and an induction coil arranged at the top end of the mold. The coil is supplied with a high frequency alternating current from a power supply. The invented device exhibits improved mechanical strength.

BACKGROUND ART

During continuous or semi-continuous casting of metals and metal alloys, a hot metal melt is supplied to a cooled continuous casting mold, i.e. a mold which is open in both ends in the casting direction. The mold is typically water-cooled and surrounded and supported by a structure of support beams. Melt is supplied to the mold where the metal is solidified and a cast strand is formed as it is passed through the mold. A cast strand leaving the mold, comprises a solidified, self-supporting surface layer or shell around a residual melt. Generally it can be said that conditions of initial solidification is critical for both quality and productivity. A lubricant is typically supplied to the upper surface of the melt in the mold. The lubricant serves many purposes, amongst others it will prevent the skin of the cast strand first developed from sticking to the mold wall. Normal adherence between oscillation show as so called oscillation marks. Should the solidified skin stick or adhere more severely to the mold it will show as severe surface defects and in some cases as ripping of the first solidified skin. For large dimension strands of steel the lubricant is predominantly a so-called mold powder comprising glass or glass forming compounds that is melted by the heat at the meniscus. The mold powder is often continuously added to the upper surface of the melt in the mold during casting, as an essentially solid, free flowing particulate powder. The composition of a mold powder is customized. Thereby the powder will melt at a desired rate and lubrication will be provided at the desired rate to ensure lubrication. A too thick layer of lubricant between mold and cast strand will also affect the solidification conditions and surface quality in an undesired way, thus the thermal conditions at the meniscus need to be controlled. For smaller strands and for non-ferrous metals oil, typically vegetable oil, or grease is used as lubricant. Irrespective of what type of mold lubricant is used it should preferably be fed into the interface cast strand/mold at an even rate sufficient to form a thin uniform film in the interface to avoid surface defects originating from adherence between mold and strand. A too thick film might cause uneven surface and disturbs the thermal situation.

Heat losses and overall thermal conditions at the meniscus are predominantly controlled by the secondary flow that is developed in the mold. The use of an inductive HF heater or another HF-device used for electromagnetic casting, an EMC-device, for influencing the thermal situation at the top end is discussed in e.g. U.S. Pat. No. 5,375,648 and in earlier not yet published Swedish Patent Application No. SE9703892-1. High thermal losses are compensated by a supply of heat to the upper surface, either by a controlled upward flow of hot melt or by a heater, otherwise the meniscus can start to solidify. Such a solidification will severely disturb the casting process and destroy the quality of the cast product in most aspects.

A high frequency inductive heater arranged at the top end of a continuous casting mold will provide means to improve the capability to control the temperature of the metal at the upper surface of the melt, the meniscus, and at the same time generate compressive forces acting to separate the melt and the mold, thereby reducing the risk for sticking, reducing oscillation mark and in general provide improved conditions for mold lubrication. This technique, which today is referred to as electromagnetic casting, EMC, for an improved lubrication and thus improved surfaces is primarily attributed to the compressive forces acting to separate the melt from the mold. The inductive heater or coil may be of single-phase or poly-phase design. Preferably a high-frequency magnetic alternating field is applied. The compressive forces, generated by the high frequency magnetic field, reduce the pressure between the mold wall and the melt, whereby the conditions for lubrication are significantly improved. Surface quality of the cast strand is improved and the casting speed can be increased without risking the surface quality. Oscillation is primarily applied to ensure that the cast strand leaves the mold. As the compressive forces act to separate the melt from the mold they will minimize any contact between the melt and mold during initial solidification of the skin and improve the feed of lubricant hereby further improving the surface quality of the cast strand. The use of an induction coil supplied with a high frequency alternating current and arranged at the meniscus is believed to provide a means to substantially improve surface quality, internal structure, cleanliness and also productivity. To increase the penetration of a high frequency magnetic field through a mold and into the melt it is known to use a Cu-mold which at the top end of the mold, i.e. at level with the high frequency induction heater is slitted in the casting direction. The slitted mold will reduce the eddy-current losses and increase the heat efficiency as the current paths for the electrical currents induced in the mold by the applied magnetic field is cut. Such molds, known as cold crucible molds, are used for other purposes and are typically used as billet molds and the like, i.e. molds for small sized strands typically with an essentially square cross-section of 200×200 mm or less. The Cu-mold is favorable due to its high heat conductivity and high electrical conductivity but has a short coming in its mechanical strength.

SUMMARY OF THE INVENTION

It is an object of the invention to provide a device for continuous casting of metal strand, wherein the conditions for the initial solidification of the cast metal in the mold are improved and in particular the conditions for mold lubrication are improved by the use of an EMC that exhibits low electromagnetic losses. In particular it is an object of the present invention to provide a device comprising a so called cold crucible mold, i.e. a mold that in its top end is slitted and thereby divided into segments which exhibit an improved mechanical integrity without any increase in the induced power losses.

A continuous casting device according to the present invention shall ensure good conditions for initial solidification within a mechanically stable mold for use together with EMC, wherein a good and controlled thermal flow, lubrication and overall conditions at the top end of the mold is provided, thus attaining considerable improvements with respect to quality and productivity. This is accomplished by the present invention, which according to one aspect provides a method for continuous or semi-continuous casting of metal according to the pre-amble of claim 1, which is characterized by the features of the characterizing part of claim. Further developments of the device are characterized by the features of additional claims 2 to 21. It is also an object of the present invention to provide a use of such continuous casting device, which is defined in claim 22.

DESCRIPTION OF THE INVENTION

A device for continuous or semi-continuous casting of metal where hot melt is supplied to a cooled continuous casting mold, the melt is cooled and at least partly solidified to a strand which is extracted from the mold and further cooled and solidified downstream of the mold and which comprises an induction coil arranged at the top end of the mold is to reduce the induced power losses typically arranged with the top end of the mold slitted into a plurality of mold segments where each slot between two mold segments is filled with a partition comprising an electrically insulating barrier. The partitions and the mold segments are oriented essentially in the casting direction. To meet the objectives mentioned in the foregoing to improve the mechanical properties of such a device for continuous or semi-continuous casting of metal comprising a cooled mold and an induction coil arranged at the top end of the mold, where the mold in its top end comprises a plurality of mold segments and a plurality of partitions oriented essentially in the casting direction and arranged to divide the mold into segments which also are oriented essentially in the casting direction and that each partition comprises an electrically insulating barrier the present invention provides a mold with top end mold segments that are hollow and comprises a core of a mechanically supporting bar or beam, such that the mechanically supporting core is surrounded by the hollow mold segment shell, wherein the supporting core exhibits superior mechanical properties in relation to the mold. In particular the stiffness and strength, tensile and bending strength, is higher for the core than for the mold. It is also favorable with a core exhibiting a high fatigue strength and a high toughness. Typically the mold exhibits an electrical conductivity higher than the electrical conductivity of the core, but this is no requirement as the low penetration depth of the HF-magnetic field limits the penetration and induction of currents to the shell and essentially no currents are induced in the reinforcing or supporting core. These mechanically reinforced mold segments according to the present invention are as known from prior art separated from each other by electrically insulating partitions Thus a device according to the present invention provides a mechanically stable mold without an increase in the induced power losses.

When the coil is supplied with an alternating electric high frequency current and a high frequency magnetic field is generated to act upon the melt in the top end of the mold the hollow mold segment, which is arranged as a shell or shield around the supporting core, provides a favorable circuit for any electrical currents induced in the mold. These currents are by the partitions restricted to one segment and the induced power losses are limited by the electrical properties of the mold, which typically comprises copper, a copper alloy or other metal with a high thermal and electrical conductivity. Thereby is the risk for high induced power losses in the supporting beams or bars substantially reduced. As the induced power losses remain low also in the mechanically improved mold comprised in a device according to the present invention a large proportion of the applied power penetrates into the melt where it is induced to develop heat in and most important to generate the desired compressive forces acting to separate the melt from the mold wall.

Typically the mold in its lower parts downstream of the coil is associated with a mold backup structure of beams or plates arranged outside the mold. This back-up structure, which normally is referred to as water-beams, is normally assembled from steel beams. The steel beams comprise internal channels for a flowing coolant such as water.

According to one embodiment suitable for casting of smaller dimensions and especially non-ferrous metals such as aluminum or copper the mold is made in one piece. This one-piece integral mold is, in the top end, divided into a plurality of segments. The segments are separated from each other by partitions. Each of the top end segments is hollow and a mechanically supporting bar or beam is arranged within each hollow segment.

Alternatively the mold exhibits an essentially square or rectangular cross section for casting of billets, slabs or blooms. Such a mold comprises four mold plates, where each mold plate in the top end is divided into a plurality of segments by partitions. In accordance with the present invention each of the top end segments is hollow and a mechanically supporting bar or beam is arranged within each hollow segment.

According to further alternative embodiments the mold comprises a plurality of elongated hollow mold segment separated from each other by partitions. A mechanically supporting bar or beam is arranged as a core in each hollow segment. The hollow mold segments are preferably made in the form of sleeves, with the top end closed, into which the cores are inserted. Alternatively tubes, with both ends open, are used as hollow mold segments such that the mold formed exhibits the cores exposed at the top end.

An assembly of hollow mold segments are held together and mechanically supported by the mold back-up structure. The elongated hollow mold segments and its associated core can in some embodiments extend over the full height of the mold but typically the hollow mold segments are restricted to the top end of the mold, at level with the induction coil, while the bottom part of the mold, downstream of the induction coil, is comprised of an integral mold or four plates Of course can the hollow mold segments at the top end be joined with the bottom part of the mold to form one integral mold or a mold comprising four mold plates.

The cores in a mold according to the present invention needs to cover at least the full length of the hollow mold segments, i.e. the full length of the partitions, and also to extend over part of the bottom part. When required for mechanical reasons the cores extend over the full length of the mold. Any bar or beam comprised as a core in the mold segments at the top end of the mold is mechanically associated with this mold back-up structure. This association can either be direct or through the surrounding hollow mold segment. According to one embodiment of the present invention the bars or beams comprised as cores in the top end mold segments are joined downstream of the partitions and the hollow mold segments to form an integral plate or other form of back-up structure.

Typically the hollow mold segments have an essentially square or rectangular cross-section and are arranged around the core, but they can have any suitable form. According to some embodiments the side facing away from the mold has a rounded or pointed surface shape to further reduce the induced power losses, while the mold segments on the melt side always have a shape in conformity with the internal shape or contour of the mold. The surfaces of the mold segments in contact with the partitions need to be sufficiently wide to provide a sufficient mold thickness to eliminate any risks for melt penetrating the mold.

According to one preferred embodiment the hollow mold segment has a minimum wall thickness corresponding to one penetration depth for the magnetic field generated by the coil or more to minimize the induced power losses.

To facilitate a longer working life for the mold the hollow mold segments are according to one embodiment provided with an increased wall thickness on the side facing the melt.

According to one embodiment the height of the hollow mold segments differ between the melt side and the outside such that the hollow mold segments on the outside faces of the mold extend from the top end of the mold to a level approximately at a level corresponding to the depth of the partitions.

Typically the mold comprises a copper or a copper alloy and that the mechanically supporting bars or beams inserted in the hollow mold segments comprise steel.

The mechanically supporting bars or beams inserted in the hollow mold segments preferably comprise internal channels or cavities for flowing coolant. Channels for a flowing coolant are when deemed appropriate arranged within the hollow mold segments or in the interface between the hollow mold segment and the supporting bar or beam.

Typically the induction coil is supplied with an alternating current having a base frequency of 50 Hz or more. Preferably the alternating current has a base frequency of 1–200 kHz.

The device according to the present invention is suitable for continuous or semi-continuous casting of metals such as steel, copper, aluminum and the like.

BRIEF DESCRIPTION OF THE DRAWINGS

In the following the invention will be explained in greater detail and be exemplified by means of preferred embodiment with reference to the accompanying figures.

DESCRIPTION OF THE PREFERRED EMBODIMENTS

Figure 1:
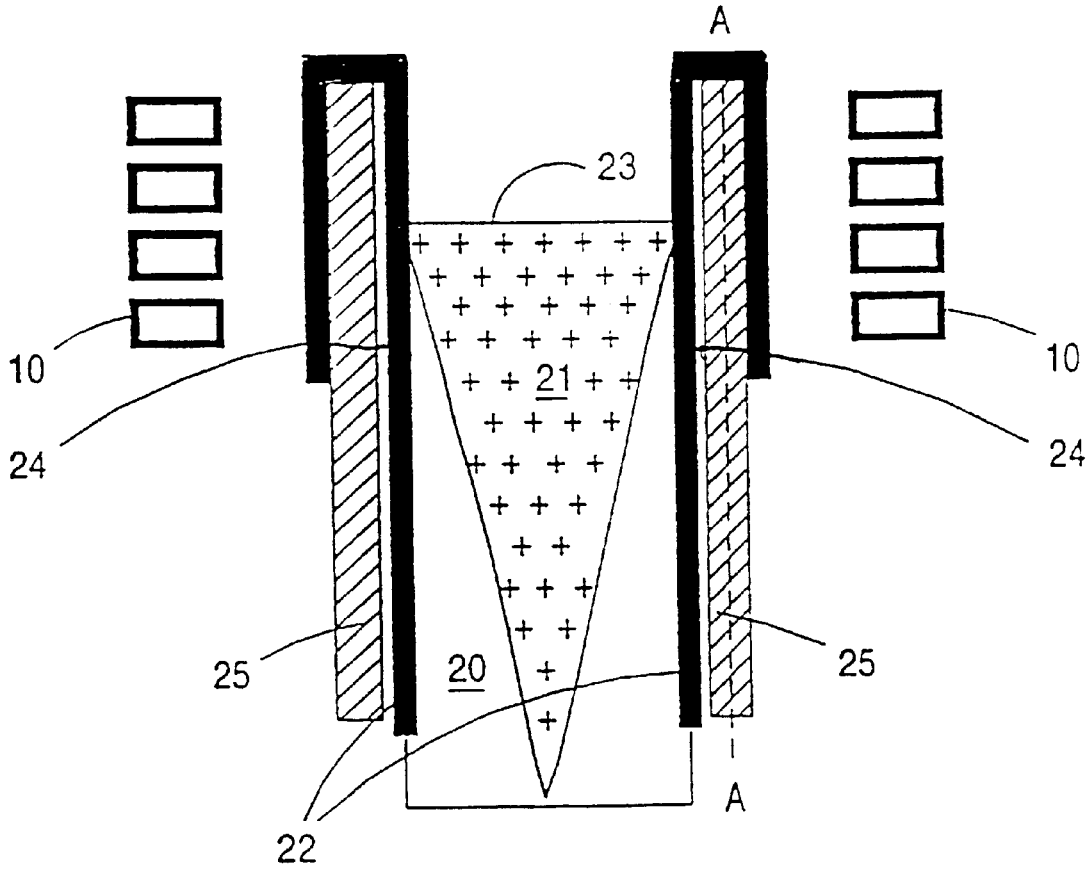
FIG. 1 shows a cut along the casting direction for a device according to one embodiment of the present invention.

The device for continuous casting of metal shown in the FIG. 1 comprises a continuous casting mold assembly comprising a mold 22 and a mold back-up structure 25 according to the present invention. The continuous casting mold is open in both ends in the casting direction and is arranged with cooling means, not shown. The continuous casting machine also includes means for supply of hot melt to the mold and means for ensuring that the formed cast strand continuously leaves the mold, not shown, and when appropriate means for oscillating the mold, not shown. The mold 22 is continuously supplied with a primary flow of hot melt, the hot metal 21 is cooled and a cast strand 20 is formed in the mold 22. The mold 22 is usually a water-cooled copper mold. The mold 22 comprises at its top end a cavity 24 into which a support beam 25 is inserted as a reinforcing or supporting core. As the metal passes through the mold 22 it is cooled and solidified whereby a cast strand 20 is formed. When the cast strand 20 leaves the mold 22, it comprises a solidified, self-supporting surface shell 20 around a remaining residual melt 21. Generally it can be said that the surface conditions and of course the cast structure is highly dependent on the conditions of initial solidification. But also metal cleanliness will depend on the conditions in the top end of the mold, i.e. the locations at which the metal starts to solidify and the conditions at the interface mold/strand and at the meniscus. To control the thermal situation at the top end of the mold 22 and the lubricating conditions is a device for generation of a high frequency magnetic field e.g. an induction coil 10 arranged at this top end at level with the top surface of the melt in the mold, the meniscus 23. The coil 10 as shown in FIG. 1 is arranged outside the mold 22. The induction coil 10 may be a single-phase or a poly-phase heater. When the high frequency magnetic alternating field is applied to act on the melt 21, heat is developed in the melt 21 so that the temperature of the melt adjacent to the meniscus 23 can be controlled. At the same time compressive forces acting on the melt 21 are developed by the high frequency alternating field. The compressive forces reduce the pressure between the mold 22 and the melt 21 and thus improve the condition for lubrication significantly. Improvements obtained when casting according to the present invention relates to a new device for electromagnetic casting,. EMC, with improved mechanical properties at the top end of the mold at level with the induction coil 10 and meniscus 23 and low induced power losses.

Figure 4:
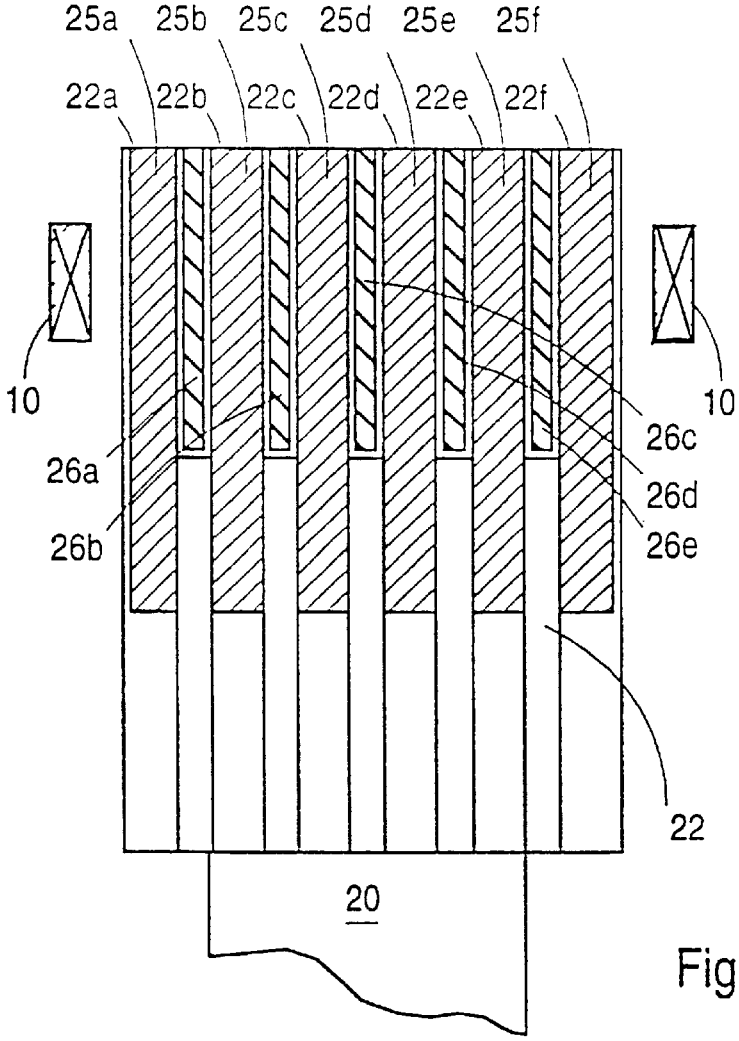
FIG. 4 shows in detail a part of a mold wall along a cut A—A in the casting direction for one embodiment of the present invention.
Figure 5:
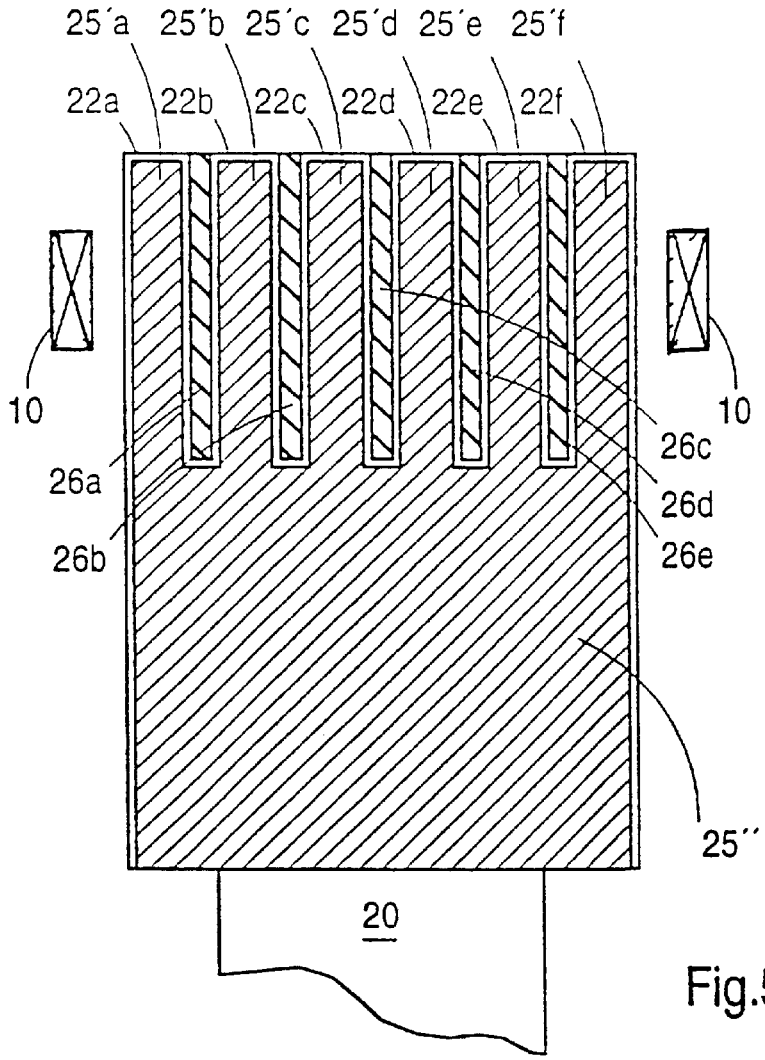
FIG. 5 shows in detail a part of a mold wall along a cut A—A in the casting direction for one alternative embodiment of the present invention.

The device according to the present invention comprises, as shown in FIGS. 2 to 5 in the top end of the mold 22 a plurality of hollow mold segments 22*a–f*, 22'*b*–22'*d*, separated from each other by partitions 26*a*–26*e*. A mechanically supporting bar or beam 25*a*–25*f* is arranged within each hollow mold segment 22*a–f*, 22'*b*–22'*d*. Such a bar exhibits superior mechanical properties in relation to the mold. In particular the stiffness, the bending strength and the tensile strength is higher for the core than for the mold. It is also favorable with a core exhibiting a high fatigue strength and high toughness. Any bar or beam 25*a*–25*f* comprised as a core in a the hollow mold segments 22*a–f*, 22'*b*–22'*d* at the top end of the mold is mechanically associated with the remaining parts of the mold back-up structure 25 at the lower end of the mold assembly. The bars or beams 25*a*–25*f* can extend over the full length of the mold 22 or as in FIG. 4 at least over the full length of the partitions 26*a*, 26*b*, 26*c*, 26*d* and 26*e*. According to the embodiment shown in FIG. 5 the bars 25'*a*–25'*f* are merged to a back-up plate 25" downstream of the partitions 26*a*, 26*b*, 26*c*, 26*d* and 26*e* or the coil 10. Thus the bars or beams comprised as cores in the hollow mold segments at the top end of the mold form an integral part of the mold back-up structure or the mold back-up plate arranged outside the mold or mold plate respectively. The cores can as indicated in FIG. 4 be inserted into cavities which are open in the top end such that they face the top surface of the mold or the cores can as indicated in FIG. 5 be covered in the top end by the mold, i.e. the cores are inserted into cavities 24 which are closed in the top end.

Figure 2:
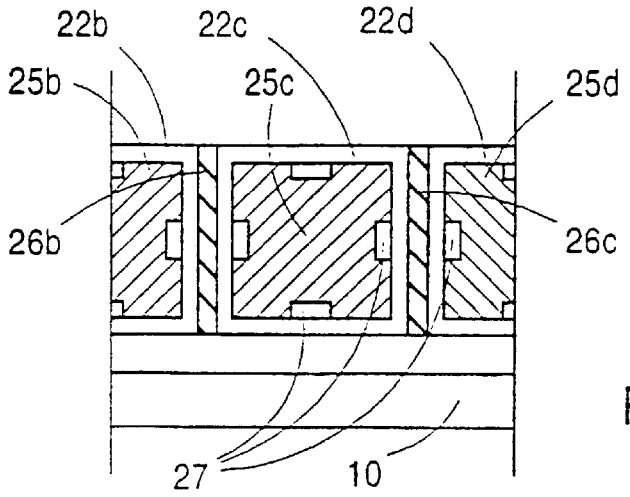
FIG. 2 shows in detail a part of the mold wall cut across the casting direction for one embodiment of the present invention.
Figure 3:
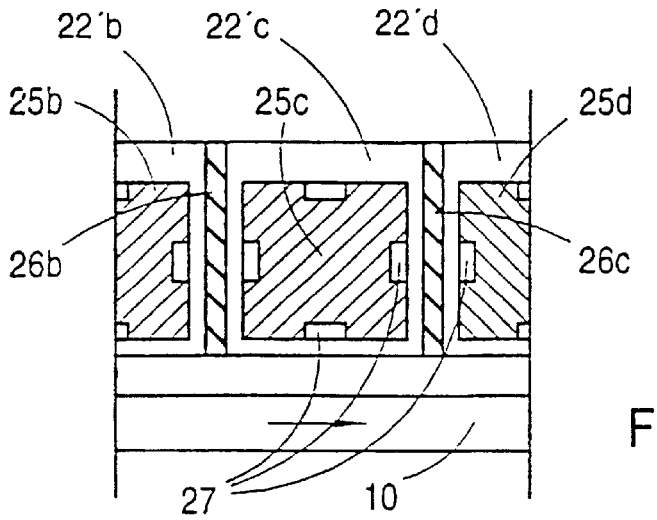
FIG. 3 shows in detail a part of the mold wall cut across the casting direction for one alternative embodiment of the present invention.

The hollow mold segments 22*a–f*, 22'*b*–22'*d* shown in FIGS. 2 and 3 have an essentially square or rectangular cross-section and are arranged around the essentially square cores 25*a*–25*f*, 25'*a*–25*f*, but the mold segments and the cores can exhibit any cross-sectional shape as long as the melt side of the hollow segments are in conformity with the internal contour or shape of the mold. The hollow mold segments 22*a–f*, 22'*b*–22*d* have a minimum wall thickness corresponding to one penetration depth for the magnetic field generated by the coil or more. According to the embodiment shown in FIG. 2 the wall thickness of the hollow mold segments 22*b*, 22*c*, 22*d* is the same for all walls, while the hollow mold segments 22'*b*, 22'*c*, 22'*d* according to the embodiment shown in FIG. 3 have an increased wall thickness on the side facing the melt. The cavity in the hollow mold segments 22*a–f*, 22'*b*–22'*d* typically extends, as indicated in FIG. 1, from the top end of the mold to a level approximately at a level corresponding to the depth of the partitions 26*a*–26*d*, but can also extend over the full length of the mold if this is deemed appropriate. The mold 22 typically comprises copper or a copper alloy and the mechanically supporting bars or beams 25*a*–25*f*, 25'*a*–25'*f* inserted in the hollow mold segments 22*a–f*, 22'*b*–22'*d* typically comprises steel. The mechanically supporting bars or beams 25*a*–25*f*, 25'*a*–25'*f*, which are inserted in the hollow mold segments 22*a–f*, 22'*b*–22'*d* comprise according to the embodiments shown in FIGS. 2 and 3 channels 27 for a flowing coolant arranged in the interface between the hollow mold segment 22*b–d*, 22'*b*–22'*d* and the supporting bar or beam 25*a*–25*d*. Such channels can also be arranged within the bar or beam, 25*a*–25*d* and/or within the hollow mold segments 22*b–d*, 22'*b*–22'*d*.

The mold typically exhibits an essentially square or rectangular cross section and comprises four mold plates or when suitable such as for casting of small dimensions or non-ferrous metals can be made as one integral one-piece mold.

The induction coil is typically supplied with an alternating current having a base frequency of 50 Hz or more, preferably with an alternating current having a base frequency of 1–200 kHz.

With a device according to the present invention and the embodiments shown in the figures many quality and productivity aspects such as;

Heat efficiency;

More mechanically stable mold;

Cleanliness;

Surface quality;

Controlled cast structure;

Reduced down-time; and

Provisions to increase casting speed and /or reduce oscillation, can be achieved without unnecessary induced power losses or short-comings due to unsatisfactory mechanical properties at the top end of the mold.

What is claimed is:

1. A device for continuous or semi-continuous casting of metal comprising:

a cooled mold and an induction coil located at a top end of said mold, a plurality of partitions at said top end of said mold which are oriented essentially in a casting direction and arranged to divide said mold into segments which are also oriented essentially in the casting direction, each partition comprising an electrically insulating barrier, the top ends of said mold segments being hollow, and supporting bars or beams as cores located in the hollow mold segments for mechanical support, said cores having superior mechanical properties relative to said mold.

2. A device according to claim 1, wherein in a lower part of said mold, downstream of the coil, a mold back-up structure of beams or plates is located outside the mold.

3. A device according to claim 1, comprising one integral mold.

4. A device according claim 1, wherein the mold has an essentially square or rectangular cross section and comprises four mold plates.

5. A device according to claim 4, wherein the elongated hollow mold segments extend over a full height of the mold, and wherein the assembly of elongated hollow segments are held together and mechanically supported by a mold back-up structure.

6. A device according to claim 5, wherein said cores at the top end of the mold are mechanically associated with said mold back-up structure.

7. A device according to claim 1, wherein the cores are joined, downstream of the partitions, to form an integral mold back-up structure or plate.

8. A device according to claim 1, wherein the hollow mold segments have an essentially square or rectangular cross-section and are arranged around the cores.

9. A device according to claim 1, wherein the hollow mold segments have a minimum wall thickness corresponding to one penetration depth for the magnetic field generated by the coil or more.

10. A device according to claim 1, wherein the hollow mold segments have an increased wall thickness on a side facing the melt.

11. A device according to claim 1, wherein the hollow mold segments on outside faces of the mold extend from the top end of the mold to a level approximately at a level corresponding to a depth of the partitions.

12. A device according to claim 1, wherein the cores extend essentially from the top end of the mold to a level below the lower end of the partitions.

13. A device according to claim 1, wherein the cores extend over essentially the full length of the mold.

14. A device according to claim 1, wherein the cores are inserted into cavities which are closed at the top end of the mold.

15. A device according to claim 1, wherein the cores are inserted into cavities which are open at the top end of the mold, such that the cores face the top end surface of the mold.

16. A device according to claim 1, wherein the mold comprises copper or a copper alloy and that the cores are mechanically supporting steel bars or beams.

17. A device according to claim 16, wherein the mechanically supporting bars or beams comprise internal channels or cavities for flowing coolant.

18. A device according to claim 17, wherein channels for a flowing coolant are arranged within the hollow mold segments.

19. A device according to claim 1, wherein the channels for a flowing coolant are arranged in the interface between the hollow mold segment and the core.

20. A device according to claim 1, wherein the induction coil is supplied with an alternating current having a base frequency of 50 Hz or more.

21. A device according to claim 20, wherein the induction coil is supplied with an alternating current having a base frequency of 1–200 kHz.

22. Use of a device according to claim 1 for continuous or semi-continuous casting of metals, comprising a cooled mold and an induction coil arranged at the top end of the mold, wherein the mold comprises in its top end a plurality of hollow mold segments separated from each other by electrically insulating partitions.

* * * * *